United States Patent [19]

Kavesh et al.

[11] 4,260,416

[45] Apr. 7, 1981

[54] AMORPHOUS METAL ALLOY FOR STRUCTURAL REINFORCEMENT

[75] Inventors: Sheldon Kavesh, Whippany; Claude Henschel, Mount Freedom, both of N.J.

[73] Assignee: Allied Chemical Corporation, Morris Township, Morris County, N.J.

[21] Appl. No.: 71,912

[22] Filed: Sep. 4, 1979

[51] Int. Cl.[3] ..... C22C 38/32; C22C 38/36; C22C 38/06

[52] U.S. Cl. ..... 75/125; 75/126 C; 75/126 Q; 75/126 P

[58] Field of Search ..... 75/125, 126 C, 126 Q, 75/126 P

[56] References Cited

U.S. PATENT DOCUMENTS

| | | | |
|---|---|---|---|
| 3,856,513 | 12/1974 | Chen et al. | 75/122 |
| 3,986,867 | 10/1976 | Masumoto et al. | 75/126 A |
| 4,052,201 | 10/1977 | Polk et al. | 75/124 |
| 4,067,732 | 1/1978 | Ray | 75/126 P |
| 4,152,144 | 5/1979 | Hasegawa et al. | 75/122 |

*Primary Examiner*—G. Ozaki
*Assistant Examiner*—Upendra Roy
*Attorney, Agent, or Firm*—Ernest D. Buff; Gerhard H. Fuchs

[57] ABSTRACT

An amorphous metal alloy has a composition defined by the formula $Fe_aCr_bC_cP_dMo_eW_fCu_gB_hSi_i$, where "a" ranges from about 61–75 atom percent, "b" ranges from about 6–10 atom percent, "c" ranges from about 11–16 atom percent, "d" ranges from about 4–10 atom percent, "e" ranges from about 0–4 atom percent, "f" ranges from about 0–0.5 atom percent, "g" ranges from about 0–1 atom percent, "h" ranges from about 0–4 atom percent and "i" ranges from about 0–2 atom percent, with the proviso that the sum [c+d+h+i] ranges from 19–24 atom percent and the fraction [c/(c+d+h+i)] is less than about 0.84. The alloy is economical to make, strong, ductile, and resists corrosion, stress corrosion and thermal embrittlement.

8 Claims, 9 Drawing Figures

CALCULATED TENSILE STRENGTH AND OVEN AGED BEND DIAMETER CONTOURS

FE - CR - (MO,W) - C - P - $B_{0.5}$ ALLOYS

CR = 8 MO = 0 W = 0 SI = 0

CALCULATED TENSILE STRENGTH AND OVEN AGED BEND DIAMETER CONTOURS

FE - CR - (MO,W) - C - P - $B_{0.5}$ ALLOYS

CR = 8 MO = 1 W = 0 Si = 0

RIBBON THICKNESS = 0.0013"

BEND DIAMETER SPECIMENS AGED 1 HR. @ 200°C

CALCULATED TENSILE STRENGTH AND OVEN AGED BEND DIAMETER CONTOURS

FE – CR – (MO,W) – C – P – $B_{0.5}$ ALLOYS

C = 14 C + P = 20 W = 0 Si = 0

CALCULATED TENSILE STRENGTH AND OVEN AGED BEND DIAMETER CONTOURS

FE – CR – (Mo,W) – C – P – $B_{0.5}$ ALLOYS

C = 14 C+P = 21 W = 0 Si = 0

CALCULATED TENSILE STRENGTH AND OVEN AGED BEND DIAMETER CONTOURS

FE — CR — (Mo,W) — C — P — $B_{0.5}$ ALLOYS

C=14 Mo=1 W=0 Si=0

CALCULATED TENSILE STRENGTH AND OVEN AGED BEND DIAMETER CONTOURS

Fe - Cr - (Mo, W) - C - P - $B_{0.5}$ ALLOYS

Cr = 8 C = 14 C + P = 20 Si = 0

RIBBON THICKNESS = 0.0013"
BEND DIAMETER SPECIMENS
AGED 1 HR. @ 200°C

ANODIC POLARIZATION MEASUREMENTS
1 N $H_2SO_4$ + $H_2$ 22°C
302 SS
316 SS
302 SS
316 SS
$Fe_{70.2}Cr_8Mo_1C_{14}P_6B_{0.5}Si_{0.3}$
$10^{-2}$
$10^{-3}$
$10^{-4}$
$10^{-5}$
$10^{-6}$
DISSOLUTION CURRENT DENSITY, amps/cm$^2$
VOLTS →
2.0
1.8
1.6
1.4
1.2
1.0
0.8
0.6
0.4
0.2
0
-0.2
-0.4
-0.6

AMORPHOUS METAL ALLOY FOR STRUCTURAL REINFORCEMENT

BACKGROUND OF THE INVENTION

1. Field of the Invention

This invention relates to amorphous metal alloys and, more particularly, to amorphous metal alloys containing iron, chromium, carbon and phosphorus combined, optionally, with minor amounts of copper, molybdenum, tungsten, boron and silicon. The amorphous metal alloys of the invention are strong, ductile and resistant to corrosion, stress corrosion and thermal embrittlement.

2. Description of the Prior Art

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. Also disclosed and claimed by the aforesaid patent to Chen et al. are amorphous alloys in wire form having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent.

More recently, iron-chromium base amorphous metal alloys have been disclosed by Masumoto et al. in U.S. Pat. No. 3,986,867. These alloys contain 1–40 atom percent chromium, 7–35 atom percent of at least one of the metalloids phosphorus, carbon and boron, balance iron and, optionally, also contain less than 40 atom percent of at least one of nickel and cobalt, less than 20 atom percent of at least one of molybdenum, zirconium, titanium and manganese, and less than 10 atom percent of at least one of vanadium, niobium, tungsten, tantalum and copper.

The alloys taught by the Chen et al. and Masumoto et al. patents evidence good mechanical properties as well as stress and corrosion resistance. Structural reinforcements used in tires, epoxies and concrete composites require improved mechanical properties, stress and corrosion resistance, and higher thermal stability. The improved properties required by these reinforcement applications have necessitated efforts to develop further specific alloy compositions. Amorphous metal alloys having improved mechanical, physical and thermal properties are taught by U.S. Pat. No. 4,067,732 and U.S. Pat. No. 4,137,075. Such alloys contain substantial quantities of scarce, strategic and valuable elements that are relatively expensive.

SUMMARY OF THE INVENTION

The present invention provides amorphous metal alloys that are economical to make and which are strong, ductile, and resist corrosion, stress corrosion and thermal embrittlement. Such alloys have the formula $Fe_aCr_bC_cP_dMo_eW_fCu_gB_hSi_i$, where "a" ranges from about 61–75 atom percent, "b" ranges from about 6–10 atom percent, "c" ranges from about 11–16 atom percent, "d" ranges from about 4–10 atom percent, "e" ranges from about 0–4 atom percent, "f" ranges from about 0–0.5 atom percent, "g" ranges from about 0–1 atom percent, "h" ranges from about 0–4 atom percent and "i" ranges from about 0–2 atom percent, with the proviso that the sum [c+d+h+i] ranges from 19–24 atom percent and the fraction [c/(c+d+h+i)] is less than about 0.84.

The alloys of this invention are primarily glassy (e.g., at least 50 percent amorphous), and preferably substantially glassy (e.g., at least 80 percent amorphous) and most preferably totally glassy (e.g., about 100 percent amorphous), as determined by X-ray diffraction.

The amorphous alloys of the invention are fabricated by a process which comprises forming melt of the desired composition and quenching at a rate of about $10^{5°}$ to $10^{6°}$ C./sec by casting molten alloy onto a chill wheel or into a quench fluid. Improved physical and mechanical properties, together with a greater degree of amorphousness, are achieved by casting the molten alloy onto a chill wheel in a partial vacuum having an absolute pressure of less than about 5.5 cm of Hg.

BRIEF DESCRIPTION OF THE DRAWINGS

The invention will be more fully understood and further advantages will become apparent when reference is made to the following detailed description and the accompanying drawings in which.

DETAILED DESCRIPTION OF THE INVENTION

Figure 1:
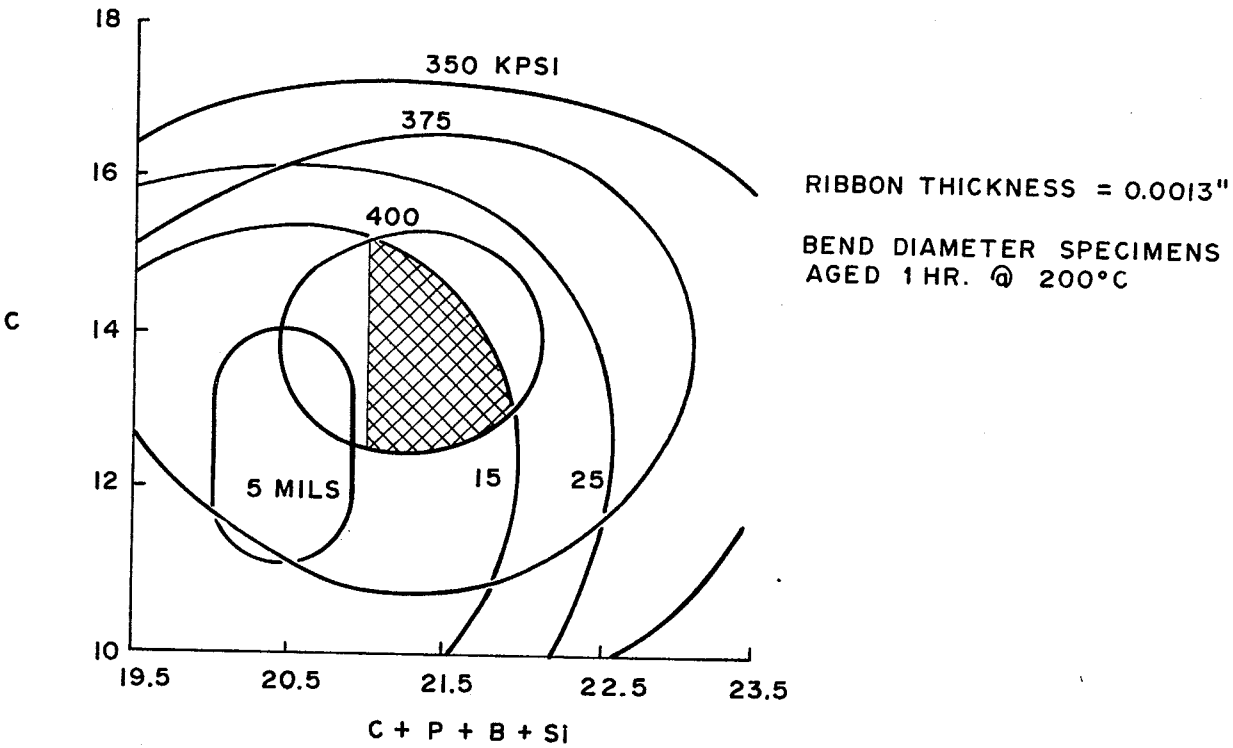
FIGS. 1–6 are graphs showing response surface contours for tensile strengths and oven-aged bend diameters for composition planes in the neighborhood of compositions of the present invention.

There are many applications which require that an alloy have, inter alia, a high ultimate tensile strength, high thermal stability, ease of fabrication and resistance to corrosion and stress corrosion. Metal filaments used as tire cord undergo a heat treatment of about 160° to 170° C. for about one hour to bond tire rubber to the metal. The thermal stability of amorphous metal tire cord filament must be sufficient to prevent complete or partial transformation from the glassy state to an equilibrium or a metastable crystalline state during such heat treatment. In addition, metal tire cord filaments must be resistant to (1) breakage resulting from high tensile loads and (2) corrosion and stress corrosion produced by sulfur-curing compounds, water and dilute salt solutions.

Resistance to chemical corrosion, though particularly important to tire cord filaments, is not possessed by brass plated steel tire cords. Rubber tires conventionally used in motor vehicles are permeable. Water vapor reaches steel tire cord filaments through cuts and cracks in the tire as well as through the rubber itself. The cord corrodes, producing defective points therein, followed by rapid procession of corrosion along the cord and, ultimately, separation of the steel reinforcement from the rubber carcass. The amorphous metal tire cord alloys of the present invention not only resist such chemical corrosion, but have lower flexural stiffness than steel tire cord. Such decreased flexural stiffness reduces rolling resistance of vehicle tires, improving fuel economy of the vehicle.

Other applications for which the amorphous metal alloys of this invention are particularly suited include reinforced plastics such as pressure vessels, reinforced rubber items such as hoses and power transmission belts, concrete composites such as prestressed concrete, cables, springs and the like.

As previously noted, thermal stability is an important property for amorphous metal alloys used to reinforce tires, pressure vessels, power transmission belts and the like. Thermal stability is characterized by the time-temperature transformation behavior of an alloy, and may be determined in part by DTA (differential thermal analysis). As considered here, relative thermal stability is also indicated by the retention of ductility in bending after thermal treatment. Alloys with similar crystallization behavior as observed by DTA may exhibit different embrittlement behavior upon exposure to the same heat treatment cycle. By DTA measurement, crystallization temperatures, $T_c$ can be accurately determined by slowly heating an amorphous alloy (at about 20° to 50° C./min) and noting whether excess heat is evolved over a limited temperature range (crystallization temperature) or whether excess heat is absorbed over a particular temperature range (glass transition temperature). In general, the glass transition temperature $T_g$ is near the lowest, or first, crystallization temperature, $T_{cl}$, and, as is convention, is the temperature at which the viscosity ranges from about $10^{13}$ to $10^{14}$ poise.

Most amorphous metal alloy compositions containing iron and chromium which include phosphorus, among other metalloids, evidence ultimate tensile strengths of about 265,000 to 350,000 psi and crystallization temperatures of about 400° to 460° C. For example, an amorphous alloy having the composition $Fe_{76}P_{16}C_4Si_2Al_2$ (the subscripts are in atom percent) has an ultimate tensile strength of about 310,000 psi and a crystallization temperature of about 460° C., an amorphous alloy having the composition $Fe_{30}Ni_{30}Co_{20}P_{13}B_5Si_2$ has an ultimate tensile strength of about 265,000 psi and a crystallization temperature of about 415° C., and an amorphous alloy having the composition $Fe_{74.3}Cr_{4.5}P_{15.9}C_5B_{0.3}$ has an ultimate tensile strength of about 350,000 psi and a crystallization temperature of 446° C. The thermal stability of these compositions in the temperature range of about 200° to 350° C. is low, as shown by a tendency to embrittle after heat treating, for example, at 250° C. for one hr. or 300° C. for 30 min. or 330° C. for 5 min. Such heat treatments are required in certain specific applications, such as curing a coating of polytetrafluoroethylene on razor blade edges or bonding tire rubber to metal wire strands.

In accordance with the invention, amorphous alloys of iron, chromium, carbon and phosphorus have high ultimate tensile strength, ductility and resistance to corrosion and stress corrosion. These alloys do not embrittle when heat treated at temperatures typically employed in subsequent processing steps. The metallic glass compositions of this invention consist essentially of the elements iron, chromium, carbon and phosphorus within specific, narrow and critical composition bounds. Additionally, minor amounts of copper, molybdenum, tungsten, boron, or silicon alone or in combination may be incorporated in the alloys for enhancement of particular properties.

Tables I–IV show the stress corrosion resistance, state (crystalline vs. glassy) and as-cast bend ductility of a series of Fe-Cr-Mo-C-P-B-Si alloys for which the elemental levels were varied.

TABLE I

Fe—Cr—Mo—C—P—$B_{0.5}$ Alloys
Ribbon Thickness = 0.001"
XTL = Crystalline

| Alloy Composition, At % | | | | | | Stress Corrosion Cracking, (SCC) | Ductility | |
|---|---|---|---|---|---|---|---|---|
| Fe | Mo | Cr | C | P | B | Days | | State |
| C + P = 18 At % | | | | | | | | |
| 1. Bal. | 0.5 | 4 | 6 | 12 | 0.5 | <1 | Ductile | 40% XTL |
| 2. Bal. | 0.5 | 4 | 14 | 4 | 0.5 | <1 | Ductile | 90% XTL |
| 3. Bal. | 0.5 | 8 | 6 | 12 | 0.5 | <1 | Ductile | 90% XTL |
| 4. Bal. | 0.5 | 8 | 14 | 4 | 0.5 | <1 | Ductile | 100% XTL |
| 5. Bal. | 2.0 | 4 | 6 | 12 | 0.5 | <1 | Ductile | 10% XTL |
| 6. Bal. | 2.0 | 4 | 14 | 4 | 0.5 | <1 | Ductile | 75% XTL |
| 7. Bal. | 2.0 | 8 | 6 | 12 | 0.5 | <1 | Ductile | 10% XTL |
| 8. Bal. | 2.0 | 8 | 14 | 4 | 0.5 | <1 | Ductile | 90% XTL |
| C + P = 19 At % | | | | | | | | |
| 9. Bal. | 1.0 | 6 | 10 | 9 | 0.5 | <1 | Ductile | 10% XTL |
| C + P = 20 At % | | | | | | | | |
| 10. Bal. | 0.5 | 4 | 6 | 14 | 0.5 | <1 | Ductile | Glassy |
| 11. Bal. | 0.5 | 4 | 14 | 6 | 0.5 | <1 | Ductile | Glassy |
| 12. Bal. | 0.5 | 8 | 6 | 14 | 0.5 | 30+ | Ductile | Glassy |
| 13. Bal. | 0.5 | 8 | 14 | 6 | 0.5 | 30+ | Ductile | Glassy |
| 14. Bal. | 1.0 | 6 | 6 | 14 | 0.5 | 30+ | Ductile | Glassy |
| 15. Bal. | 1.0 | 6 | 14 | 6 | 0.5 | 23 | Ductile | Glassy |
| 16. Bal. | 2.0 | 4 | 6 | 14 | 0.5 | <1 | Ductile | Glassy |
| 17. Bal. | 2.0 | 4 | 14 | 6 | 0.5 | <1 | Ductile | Glassy |
| 18. Bal. | 2.0 | 8 | 6 | 14 | 0.5 | 30+ | Ductile | Glassy |
| 19. Bal. | 2.0 | 8 | 14 | 6 | 0.5 | 30+ | Ductile | Glassy |
| C + P = 21 At % | | | | | | | | |
| 20. Bal. | 0.5 | 4 | 6 | 15 | 0.5 | <1 | Ductile | Glassy |
| 21. Bal. | 0.5 | 4 | 14 | 7 | 0.5 | <1 | Ductile | Glassy |
| 22. Bal. | 0.5 | 8 | 6 | 15 | 0.5 | 20+ | Ductile | Glassy |
| 23. Bal. | 0.5 | 8 | 14 | 7 | 0.5 | <1 | Ductile | Glassy |
| 24. Bal. | 1.0 | 6 | 6 | 15 | 0.5 | <1 | Ductile | Glassy |
| 25. Bal. | 1.0 | 6 | 14 | 7 | 0.5 | 30+ | Ductile | Glassy |
| 26. Bal. | 2.0 | 4 | 6 | 15 | 0.5 | <1 | Ductile | Glassy |
| 27. Bal. | 2.0 | 4 | 14 | 7 | 0.5 | 1 | Ductile | Glassy |
| 28. Bal. | 2.0 | 8 | 6 | 15 | 0.5 | 30+ | Ductile | Glassy |
| 29. Bal. | 2.0 | 8 | 14 | 7 | 0.5 | 30+ | Ductile | Glassy |
| C + P = 22 At % | | | | | | | | |
| 30. Bal. | 0.5 | 4 | 10 | 12 | 0.5 | <1 | Ductile | Glassy |
| 31. Bal. | 0.5 | 8 | 10 | 12 | 0.5 | 30+ | Ductile | Glassy |
| 32. Bal. | 1.0 | 6 | 10 | 12 | 0.5 | 4 | Ductile | Glassy |
| 33. Bal. | 2.0 | 4 | 10 | 12 | 0.5 | 2 | Ductile | Glassy |
| 34. Bal. | 2.0 | 8 | 10 | 12 | 0.5 | 30+ | Ductile | Glassy |
| C + P = 23 At % | | | | | | | | |
| 35. Bal. | 0.5 | 4 | 6 | 17 | 0.5 | 30+ | Ductile | Glassy |
| 36. Bal. | 0.5 | 4 | 14 | 9 | 0.5 | <1 | Ductile | Glassy |
| 37. Bal. | 0.5 | 8 | 6 | 17 | 0.5 | 30+ | Ductile | Glassy |
| 38. Bal. | 0.5 | 8 | 14 | 9 | 0.5 | 30+ | Ductile | Glassy |
| 39. Bal. | 1.0 | 6 | 6 | 17 | 0.5 | 30+ | Ductile | Glassy |
| 40. Bal. | 1.0 | 6 | 14 | 9 | 0.5 | 30+ | Ductile | Glassy |
| 41. Bal. | 2.0 | 4 | 6 | 17 | 0.5 | 30+ | Ductile | Glassy |
| 42. Bal. | 2.0 | 4 | 14 | 9 | 0.5 | <1 | Ductile | Glassy |
| C + P = 24 At % | | | | | | | | |
| 43. Bal. | 0.5 | 4 | 6 | 18 | 0.5 | 30+ | Ductile | Glassy |
| 44. Bal. | 0.5 | 4 | 14 | 10 | 0.5 | 30+ | Ductile | Glassy |
| 45. Bal. | 0.5 | 8 | 6 | 18 | 0.5 | 30+ | Brittle | Glassy |
| 46. Bal. | 0.5 | 8 | 14 | 10 | 0.5 | 30+ | Brittle | Glassy |
| 47. Bal. | 2.0 | 4 | 6 | 18 | 0.5 | 30+ | Ductile | Glassy |
| 48. Bal. | 2.0 | 4 | 14 | 10 | 0.5 | 30+ | Ductile | Glassy |
| 49. Bal. | 2.0 | 8 | 14 | 10 | 0.5 | 30+ | Brittle | Glassy |
| C + P = 26 At % | | | | | | | | |
| 50. Bal. | 1.0 | 6 | 14 | 11 | 0.5 | 30+ | Brittle | Glassy |
| C + P = 26 At % | | | | | | | | |
| 51. Bal. | 0.5 | 4 | 6 | 20 | 0.5 | 30+ | Ductile | Glassy |
| 52. Bal. | 0.5 | 4 | 14 | 12 | 0.5 | 30+ | Ductile | Glassy |

TABLE I-continued

Fe—Cr—Mo—C—P—$B_{0.5}$ Alloys
Ribbon Thickness = 0.001"
XTL = Crystalline

| Alloy Composition, At % | | | | | | Stress Corrosion Cracking, (SCC) | | |
|---|---|---|---|---|---|---|---|---|
| Fe | Mo | Cr | C | P | B | Days | Ductility | State |
| 53. Bal. | 0.5 | 8 | 6 | 20 | 0.5 | 30+ | Brittle | Glassy |
| 54. Bal. | 0.5 | 8 | 14 | 12 | 0.5 | 30+ | Brittle | Glassy |
| 55. Bal. | 2.0 | 4 | 6 | 20 | 0.5 | 30+ | Brittle | Glassy |
| 56. Bal. | 2.0 | 4 | 14 | 12 | 0.5 | 30+ | Brittle | Glassy |
| 57. Bal. | 2.0 | 8 | 6 | 20 | 0.5 | 30+ | Brittle | Glassy |
| 58. Bal. | 2.0 | 8 | 14 | 12 | 0.5 | 30+ | Brittle | Glassy |
| C + P = 28 At % | | | | | | | | |
| 59. Bal. | 0.5 | 4 | 6 | 22 | 0.5 | 30+ | Brittle | Glassy |
| 60. Bal. | 0.5 | 4 | 14 | 14 | 0.5 | 30+ | Brittle | Glassy |
| 61. Bal. | 0.5 | 8 | 6 | 22 | 0.5 | 30+ | Brittle | Glassy |
| 62. Bal. | 0.5 | 8 | 14 | 14 | 0.5 | 30+ | Brittle | Glassy |
| 63. Bal. | 2.0 | 4 | 6 | 22 | 0.5 | 30+ | Brittle | Glassy |
| 64. Bal. | 2.0 | 4 | 14 | 14 | 0.5 | 30+ | Brittle | Glassy |
| 65. Bal. | 2.0 | 8 | 6 | 22 | 0.5 | 30+ | Brittle | Glassy |
| 66. Bal. | 2.0 | 8 | 14 | 14 | 0.5 | 30+ | Brittle | Glassy |

TABLE II

Fe—Cr—Mo—C—P—$B_{0.5}$ Alloys
Ribbon Thickness = 0.001"
C + P = 20 At %

| Alloy Composition, At % | | | | | | Stress Corrosion Cracking, (SCC) | | |
|---|---|---|---|---|---|---|---|---|
| Fe | Mo | Cr | C | P | B | Days | Ductility | State |
| 1. Bal. | 1 | 6 | 14 | 6 | 0.5 | 3 | Ductile | Glassy |
| 2. Bal. | 1 | 6 | 16 | 4 | 0.5 | 30+ | Ductile | Glassy |
| 3. Bal. | 1 | 10 | 14 | 6 | 0.5 | 30+ | Ductile | Glassy |
| 4. Bal. | 1 | 10 | 16 | 4 | 0.5 | 30+ | Ductile | Glassy |
| 5. Bal. | 1 | 14 | 14 | 6 | 0.5 | 30+ | Brittle | Glassy |
| 6. Bal. | 1 | 14 | 16 | 4 | 0.5 | 30+ | Ductile | Glassy |
| 7. Bal. | 1 | 18 | 16 | 4 | 0.5 | 6+ | Brittle | Glassy |
| 8. Bal. | 4 | 6 | 14 | 6 | 0.5 | 1 | Ductile | Glassy |
| 9. Bal. | 4 | 6 | 16 | 4 | 0.5 | 30+ | Ductile | Glassy |
| 10. Bal. | 4 | 10 | 14 | 6 | 0.5 | 27+ | Brittle | Glassy |
| 11. Bal. | 4 | 10 | 16 | 4 | 0.5 | 30+ | Brittle | Glassy |
| 12. Bal. | 4 | 14 | 14 | 6 | 0.5 | 24+ | Brittle | Glassy |
| 13. Bal. | 4 | 14 | 16 | 4 | 0.5 | 24+ | Brittle | Glassy |
| 14. Bal. | 9 | 6 | 14 | 6 | 0.5 | 27+ | Brittle | Glassy |
| 15. Bal. | 9 | 6 | 16 | 4 | 0.5 | <1 | Ductile | Glassy |
| 16. Bal. | 9 | 10 | 14 | 6 | 0.5 | 24+ | Brittle | Glassy |
| 17. Bal. | 9 | 10 | 16 | 4 | 0.5 | 30+ | Brittle | Glassy |
| 18. Bal. | 9 | 14 | 14 | 6 | 0.5 | 26+ | Brittle | Glassy |
| 19. Bal. | 9 | 14 | 16 | 4 | 0.5 | 24+ | Brittle | Glassy |
| 20. Bal. | 16 | 6 | 14 | 6 | 0.5 | 26+ | Brittle | 20% XTL |
| 21. Bal. | 16 | 6 | 16 | 4 | 0.5 | 30+ | Brittle | 5% XTL |
| 22. Bal. | 16 | 10 | 14 | 6 | 0.5 | 26+ | Brittle | 50% XTL |
| 23. Bal. | 16 | 10 | 16 | 4 | 0.5 | 21+ | Brittle | 10% XTL |
| 24. Bal. | 16 | 14 | 14 | 6 | 0.5 | 26+ | Brittle | 100% XTL |
| 25. Bal. | 16 | 14 | 16 | 4 | 0.5 | 0 | Brittle | 100% XTL |
| 26. Bal. | 16 | 18 | 16 | 4 | 0.5 | 5 | Brittle | 90% XTL |

TABLE III

Fe—Cr—$Mo_1$—C—P—$B_{0.5}$ Alloys
Ribbon Thickness = 0.001"

| Alloy Composition, At % | | | | | | Stress Corrosion Cracking, (SCC) | | |
|---|---|---|---|---|---|---|---|---|
| Fe | Mo | Cr | C | P | B | Days | Ductility | State |
| 1. Bal. | 1 | 8 | 14 | 5 | 0.5 | 30+ | Ductile | Glassy |
| 2. Bal. | 1 | 8 | 16 | 3 | 0.5 | 30+ | Ductile | Glassy |
| 3. Bal. | 1 | 9 | 15 | 4 | 0.5 | 30+ | Ductile | Glassy |

TABLE III-continued

Fe—Cr—$Mo_1$—C—P—$B_{0.5}$ Alloys
Ribbon Thickness = 0.001"

| Alloy Composition, At % | | | | | | Stress Corrosion Cracking, (SCC) | | |
|---|---|---|---|---|---|---|---|---|
| Fe | Mo | Cr | C | P | B | Days | Ductility | State |
| 4. Bal. | 1 | 10 | 14 | 5 | 0.5 | 30+ | Ductile | Glassy |
| 5. Bal. | 1 | 10 | 16 | 3 | 0.5 | 30+ | Ductile | Glassy |

TABLE IV

Fe—$Cr_8$—$Mo_1$—C—P—B—Si Alloys

| Alloy Composition, At % | | | | | | | Stress Corrosion Cracking, (SCC) | | |
|---|---|---|---|---|---|---|---|---|---|
| Fe | Mo | Cr | C | P | B | Si | Days | Ductility | State |
| 1. Bal. | 1 | 8 | 12 | 8 | 0 | 0 | 30+ | Ductile | Glassy |
| 2. Bal. | 1 | 8 | 14 | 6 | 0 | 0 | 30+ | Ductile | Glassy |
| 3. Bal. | 1 | 8 | 12 | 7.5 | 0.5 | 0 | 30+ | Ductile | Glassy |
| 4. Bal. | 1 | 8 | 14 | 5.5 | 0.5 | 0 | 30+ | Ductile | Glassy |
| 5. Bal. | 1 | 8 | 12 | 7 | 1.0 | 0 | 30+ | Ductile | Glassy |
| 6. Bal. | 1 | 8 | 14 | 5 | 1.0 | 0 | 30+ | Ductile | Glassy |
| 7. Bal. | 1 | 8 | 12 | 6 | 2.0 | 0 | 30+ | Ductile | Glassy |
| 8. Bal. | 1 | 8 | 14 | 4 | 2.0 | 0 | 30+ | Ductile | Glassy |
| 9. Bal. | 1 | 8 | 12 | 4 | 4.0 | 0 | 30+ | Ductile | Glassy |
| 10. Bal. | 1 | 8 | 14 | 2 | 4.0 | 0 | 30+ | Ductile | Glassy |
| 11. Bal. | 1 | 8 | 12 | 8 | 0 | 0 | 30+ | Ductile | Glassy |
| 12. Bal. | 1 | 8 | 14 | 6 | 0 | 0 | 30+ | Ductile | Glassy |
| 13. Bal. | 1 | 8 | 12 | 7.7 | 0 | 0.3 | 30+ | Ductile | Glassy |
| 14. Bal. | 1 | 8 | 14 | 5.7 | 0 | 0.3 | 30+ | Ductile | Glassy |
| 15. Bal. | 1 | 8 | 12 | 7 | 0 | 1.0 | 30+ | Ductile | Glassy |
| 16. Bal. | 1 | 8 | 14 | 5 | 0 | 1.0 | 30+ | Ductile | Glassy |
| 17. Bal. | 1 | 8 | 12 | 6 | 0 | 2.0 | 30+ | Ductile | Glassy |
| 18. Bal. | 1 | 8 | 14 | 4 | 0 | 2.0 | 30+ | Ductile | Glassy |
| 19. Bal. | 1 | 8 | 12 | 4 | 0 | 4.0 | 30+ | Ductile | Glassy |
| 20. Bal. | 1 | 8 | 14 | 2 | 0 | 4.0 | 30+ | Ductile | Glassy |

It will be seen that the region of glass formation includes the following composition ranges expressed by Eq. 1.

$$19.5 \leqq (C + P + B + Si) \leqq 29 \text{ at.\%} \qquad \text{Eq. 1}$$
$$O \leqq Cr \leqq 18 + \text{at.\%}; \; O \leqq Mo \leqq 9 \text{ at.\%}.$$

That is to say, glass formation is favored in a particular range of metalloid contents and at low concentrations of chromium and molybdenum. For example, some specific alloys that fall within the composition bounds of Eq. 1 and are at least 95% glassy as measured by X-ray diffraction are set forth below:

| | |
|---|---|
| $Fe_{72.5}Cr_6Mo_1C_{14}P_6B_{0.5}$ | Glassy |
| $Fe_{67}Cr_8Mo_{0.5}C_6P_{18}B_{0.5}$ | Glassy |
| $Fe_{59.5}Cr_4Mo_8C_{14}P_{14}B_{0.5}$ | Glassy |

The following alloys of Tables I and II fall outside of the bounds of Eq. 1 and are crystalline to the extent of 10% or more:

| | |
|---|---|
| $Fe_{73.5}Cr_6Mo_1C_{10}P_9B_{0.5}$ | 10% crystalline |
| $Fe_{57.5}Cr_6Mo_{16}C_{14}P_6B_{0.5}$ | 20% crystalline |
| $Fe_{45.5}Cr_{18}Mo_{16}C_{16}P_4B_{0.5}$ | 100% crystalline |

It is necessary that the alloys be glassy to accomplish the objectives of the invention. In addition, it is further necessary that the alloys possess adequate stress corrosion resistance. Stress corrosion resistance is generally measured under conditions which simulate the stresses and corrosive environments that such alloys are likely to experience in service. In order to test the alloys of this invention under such conditions, test specimens were prepared from ribbons or wire cast from the melt and wrapped in a spiral around a 4 mm diameter mandrel. The specimens were continuously exposed to a 23° C. environment maintained at 92% relative humidity. The test was terminated when the specimen broke or had been subjected to 30 days of exposure. It had been observed that when a specimen exceeded 30 days of continuous testing without failure, its resistance to stress corrosion failure would be evidenced for very long periods of time.

Examination of the stress corrosion data of Tables I–IV shows that alloys which are glassy and which additionally possess favorable stress corrosion resistance (30+ days) must satisfy Eq. 1 and the additional criteria set forth in Eq. 2:

$$Cr + (C + P + B + Si) + 0.5Mo \geqq 28.5 \qquad \text{Eq. 2}$$

That is to say, resistance to stress corrosion is favored at higher levels of chromium, metalloid and molybdenum.

For example, the following alloys which fall within the composition bounds of Eq. 1 and Eq. 2 are glassy and show favorable stress corrosion resistance.

| | |
|---|---|
| $Fe_{67}Cr_8Mo_1C_{14}P_6B_{0.5}$ | Glassy; 30+ days |
| $Fe_{71}Cr_4Mo_{0.5}C_{14}P_{10}B_{2.5}$ | Glassy; 30+ days |

In comparison, the following alloys which fall within the composition bounds of Eq. 1 but outside of the bounds of Eq. 2 were glassy but showed stress corrosion cracking in less than 30 days' exposure:

| | |
|---|---|
| $Fe_{72.5}Cr_6Mo_1C_{14}P_6B_{0.5}$ | Glassy; 23 days |
| $Fe_{75}Cr_4Mo_{0.5}C_{14}P_6B_{0.5}$ | Glassy; <1 day |

Further, it is necessary to accomplishment of the objectives of the invention that the alloys be ductile in the as-cast state. Ductility was measured by bending the cast alloy ribbons end on end to form a loop. The diameter of the loop was gradually reduced between the anvils of a micrometer. The ribbons were considered ductile if they could be bent to a radius of about 5 mils (0.005 inch) without fracture. If a ribbon fractured, it was considered to be brittle.

Consolidation of the data of Tables I–IV shows that alloys which are ductile in the as-cast state must satisfy Eq. 1 and the following additional constraints.

$$Cr + Mo + (C + P + B + Si) \leqq 31 \qquad \text{Eq. 3}$$
$$C + P + B + Si < 27$$
$$C/(C + P + B + Si) < 0.84$$
$$Cr \leqq 14$$
$$Mo < 4$$
$$Cr + Mo < 14$$

That is to say, as-cast bend ductility is favored at low levels of chromium, molybdenum and metalloid and also by a low proportion of carbon in the total metalloid content.

For example, the following alloys which fall within the composition bounds of Eq. 1 and Eq. 3 are glassy and were ductile in the as-cast state.

| | |
|---|---|
| $Fe_{69.5}Cr_8Mo_2C_{14}P_6B_{0.5}$ | Glassy; ductile |
| $Fe_{75}Cr_4Mo_{0.5}C_{14}P_6B_{0.5}$ | Glassy; ductile |

However, the following alloys which fall within the composition bounds of Eq. 1 but outside the bounds of Eq. 3 were glassy but brittle in the as-cast state.

| | |
|---|---|
| $Fe_{64.5}Cr_{14}Mo_1C_{14}P_6B_{0.5}$ | Glassy; brittle |
| $Fe_{64.5}Cr_6Mo_9C_{14}P_6B_{0.5}$ | Glassy; brittle |
| $Fe_{67}Cr_4Mo_{0.5}C_{14}P_{14}B_{0.5}$ | Glassy; brittle |

It will be noted that Eqs. 1–3 are considerably more restrictive than the descriptions of prior art. Further, the requirements of achieving high resistance to stress corrosion and good bend ductility appear to be conflicting.

Tensile strength and thermal embrittlement data are presented in Tables V–X for a particular group of alloys that fall within the constraints of Eqs. 1–3. Each of these alloys is glassy, ductile in the as-cast state and resistant to stress corrosion cracking. Some of the alloys also possess combinations of high tensile strengths and low oven-aged bend diameters, i.e., high resistance to thermal embrittlement.

As used hereinafter in the specification and claims, the term "bend diameter" is defined as D=S−2T, where D is the bend diameter in mils, S is the minimum spacing between micrometer anvils within which a ribbon may be looped without breakage, and T is the ribbon thickness. The term "oven-aged" is defined as exposure to 200° C. for 1 hr.

TABLE V $Fe—Cr_6—Mo—W—C—P—B_{0.5}$ Alloys

| | Alloy Composition, At % | | | | | | | Tensile Strength, | Oven-Aged Bend Diameter, |
|---|---|---|---|---|---|---|---|---|---|
| | Fe | Cr | W | Mo | C | P | B | kpsi | Mils |
| 1. | Bal. | 6 | 0 | 0 | 14 | 6 | 0.5 | 381 | 4 |
| 2. | Bal. | 6 | 0 | 0.25 | 14 | 6 | 0.5 | 386 | 0 |
| 3. | Bal. | 6 | 0 | 0.50 | 14 | 6 | 0.5 | 447 | 0 |
| 4. | Bal. | 6 | 0 | 1.0 | 14 | 6 | 0.5 | 395 | 0 |
| 5. | Bal. | 6 | 0 | 0 | 15 | 5 | 0.5 | 366 | 10 |
| 6. | Bal. | 6 | 0 | 0.25 | 15 | 5 | 0.5 | 413 | 0 |
| 7. | Bal. | 6 | 0 | 0.50 | 15 | 5 | 0.5 | 451 | 0 |
| 8. | Bal. | 6 | 0 | 1.0 | 15 | 5 | 0.5 | 391 | 7 |
| 9. | Bal. | 6 | 0.25 | 0 | 14 | 6 | 0.5 | 371 | 9 |
| 10. | Bal. | 6 | 0.25 | 0.25 | 14 | 6 | 0.5 | 386 | 3 |
| 11. | Bal. | 6 | 0.25 | 0.5 | 14 | 6 | 0.5 | 431 | 0 |
| 12. | Bal. | 6 | 0.25 | 0 | 15 | 5 | 0.5 | 403 | 4 |
| 13. | Bal. | 6 | 0.25 | 0.25 | 15 | 5 | 0.5 | 410 | 5 |
| 14. | Bal. | 6 | 0.25 | 0.5 | 15 | 5 | 0.5 | 404 | 0 |
| 15. | Bal. | 6 | 0.50 | 0.50 | 14 | 6 | 0.5 | 385 | 2 |
| 16. | Bal. | 6 | 0.50 | 0.50 | 15 | 5 | 0.5 | 415 | 0 |
| 17. | Bal. | 6 | 1.0 | 0 | 14 | 6 | 0.5 | 417 | 0 |
| 18. | Bal. | 6 | 1.0 | 0 | 15 | 5 | 0.5 | 413 | 0 |

TABLE VI $Fe—Cr_8—Mo—W—C—P—B_{0.5}$ Alloys

| | Alloy Composition, At % | | | | | | | Tensile Strength, | Oven-Aged Bend Diameter, |
|---|---|---|---|---|---|---|---|---|---|
| | Fe | Cr | W | Mo | C | P | B | kpsi | Mils |
| 1. | Bal. | 8 | 0 | 0 | 14 | 6 | 0.5 | 424 | 5 |
| 2. | Bal. | 8 | 0 | 0.25 | 14 | 6 | 0.5 | 370 | 6 |
| 3. | Bal. | 8 | 0 | 0.50 | 14 | 6 | 0.5 | 418 | 4 |

TABLE VI-continued

Fe—$Cr_8$—Mo—W—C—P—$B_{0.5}$ Alloys

| Alloy Composition, At % | | | | | | | Tensile Strength, | Oven-Aged Bend Diameter, |
|---|---|---|---|---|---|---|---|---|
| Fe | Cr | W | Mo | C | P | B | kpsi | Mils |
| 4. Bal. | 8 | 0 | 1.0 | 14 | 6 | 0.5 | 417 | 5 |
| 5. Bal. | 8 | 0 | 0 | 15 | 5 | 0.5 | 420 | 5 |
| 6. Bal. | 8 | 0 | 0.25 | 15 | 5 | 0.5 | 388 | 2 |
| 7. Bal. | 8 | 0 | 0.50 | 15 | 5 | 0.5 | 429 | 0 |
| 8. Bal. | 8 | 0 | 1.0 | 15 | 5 | 0.5 | 420 | 11 |
| 9. Bal. | 8 | 0.25 | 0 | 14 | 6 | 0.5 | 408 | 22 |
| 10. Bal. | 8 | 0.25 | 0.25 | 14 | 6 | 0.5 | 423 | 11 |
| 11. Bal. | 8 | 0.25 | 0.50 | 14 | 6 | 0.5 | 438 | 26 |
| 12. Bal. | 8 | 0.25 | 0 | 15 | 5 | 0.5 | 414 | 0 |
| 13. Bal. | 8 | 0.25 | 0.25 | 15 | 5 | 0.5 | 403 | 0 |
| 14. Bal. | 8 | 0.25 | 0.50 | 15 | 5 | 0.5 | 430 | 28 |
| 15. Bal. | 8 | 0.50 | 0.50 | 14 | 6 | 0.5 | 384 | 18 |
| 16. Bal. | 8 | 0.50 | 0.50 | 15 | 5 | 0.5 | 413 | 14 |
| 17. Bal. | 8 | 1.0 | 0 | 14 | 6 | 0.5 | 393 | 15 |
| 18. Bal. | 8 | 1.0 | 0 | 15 | 5 | 0.5 | 423 | 25 |

TABLE VII

Fe—Cr—Mo—C—P—$B_{0.5}$ Alloys

| Alloy Compositions, At % | | | | | | Tensile Strength, | Oven-Aged Bend Diameter, |
|---|---|---|---|---|---|---|---|
| Fe | Cr | Mo | C | P | B | kpsi | Mils |
| 1. Bal. | 6 | 0.25 | 13 | 7 | 0.5 | 371 | 0 |
| 2. Bal. | 6 | 0.25 | 14 | 6 | 0.5 | 373 | 0 |
| 3. Bal. | 6 | 0.25 | 15 | 5 | 0.5 | 397 | 0 |
| 4. Bal. | 6 | 0.25 | 13 | 9 | 0.5 | 392 | 19 |
| 5. Bal. | 6 | 0.25 | 14 | 8 | 0.5 | 363 | 13 |
| 6. Bal. | 6 | 0.25 | 15 | 7 | 0.5 | 381 | 13 |
| 7. Bal. | 8 | 0.25 | 13 | 7 | 0.5 | 352 | 0 |
| 8. Bal. | 8 | 0.25 | 14 | 6 | 0.5 | 382 | 25 |
| 9. Bal. | 8 | 0.25 | 15 | 5 | 0.5 | 355 | 9 |
| 10. Bal. | 8 | 0.25 | 13 | 9 | 0.5 | 369 | 28 |
| 11. Bal. | 8 | 0.25 | 14 | 8 | 0.5 | 362 | 23 |
| 12. Bal. | 8 | 0.25 | 15 | 7 | 0.5 | 409 | 26 |
| 13. Bal. | 7 | 0.5 | 14 | 7 | 0.5 | 391 | 20 |
| 14. Bal. | 6 | 1.0 | 13 | 7 | 0.5 | 392 | 0 |
| 15. Bal. | 6 | 1.0 | 14 | 6 | 0.5 | 395 | 0 |
| 16. Bal. | 6 | 1.0 | 15 | 5 | 0.5 | 340 | 7 |
| 17. Bal. | 6 | 1.0 | 13 | 9 | 0.5 | 391 | 25 |
| 18. Bal. | 6 | 1.0 | 14 | 8 | 0.5 | 395 | 19 |
| 19. Bal. | 6 | 1.0 | 15 | 7 | 0.5 | 409 | 21 |
| 20. Bal. | 8 | 1.0 | 13 | 7 | 0.5 | 423 | 16 |
| 21. Bal. | 8 | 1.0 | 14 | 6 | 0.5 | 417 | 0 |
| 22. Bal. | 8 | 1.0 | 15 | 5 | 0.5 | 420 | 11 |
| 23. Bal. | 8 | 1.0 | 13 | 9 | 0.5 | 393 | 29 |
| 24. Bal. | 8 | 1.0 | 14 | 8 | 0.5 | 398 | 29 |
| 25. Bal. | 8 | 1.0 | 15 | 7 | 0.5 | 409 | 27 |

TABLE VIII

Fe—Cr—Mo—C—P—$B_{0.5}$ Alloys

| Alloy Composition, At % | | | | | | Tensile Strength, | Oven-Aged Bend Diameter, |
|---|---|---|---|---|---|---|---|
| Fe | Cr | Mo | C | P | B | kpsi | Mils |
| 1. Bal. | 8 | 0 | 15 | 5 | 0.5 | 377 | 5 |
| 2. Bal. | 8 | 0 | 16 | 4 | 0.5 | 380 | 28 |
| 3. Bal. | 8 | 0 | 17 | 3 | 0.5 | 217 | 64 |
| 4. Bal. | 8 | 0.5 | 15 | 5 | 0.5 | 402 | 2 |
| 5. Bal. | 8 | 0.5 | 16 | 4 | 0.5 | 334 | 4 |
| 6. Bal. | 8 | 0.5 | 17 | 3 | 0.5 | 253 | 21 |
| 7. Bal. | 9 | 0.25 | 16 | 4 | 0.5 | 357 | 40 |
| 8. Bal. | 10 | 0 | 15 | 5 | 0.5 | 363 | 8 |
| 9. Bal. | 10 | 0 | 16 | 4 | 0.5 | 339 | 12 |
| 10. Bal. | 10 | 0 | 17 | 3 | 0.5 | 249 | 58 |
| 11. Bal. | 10 | 0.5 | 15 | 5 | 0.5 | 426 | 6 |
| 12. Bal. | 10 | 0.5 | 16 | 4 | 0.5 | 289 | 41 |
| 13. Bal. | 10 | 0.5 | 17 | 3 | 0.5 | 234 | 63 |

TABLE IX

Fe—Cr—$Mo_1$—C—P—$B_{0.8}$ Alloys

| Alloy Composition, At % | | | | | | Tensile Strength, | Oven-Aged Bend Diameter, |
|---|---|---|---|---|---|---|---|
| Fe | Cr | Mo | C | P | B | kpsi | Mils |
| 1. Bal. | 8 | 1 | 14 | 5 | 0.8 | 286 | 0 |
| 2. Bal. | 9 | 1 | 15 | 4 | 0.8 | 417 | 0 |
| 3. Bal. | 10 | 1 | 14 | 5 | 0.8 | 377 | 12 |

TABLE X

Fe—$Cr_8$—$Mo_1$—C—P—B—Si Alloys

| Alloy Composition, At % | | | | | | | Tensile Strength, | Oven-Aged Bend Diameter, |
|---|---|---|---|---|---|---|---|---|
| Fe | Cr | Mo | C | P | B | Si | kpsi | Mils |
| 1. Bal. | 8 | 1 | 12 | 8 | 0 | 0 | 360 | 5 |
| 2. Bal. | 8 | 1 | 14 | 6 | 0 | 0 | 360 | 8 |
| 3. Bal. | 8 | 1 | 12 | 7.5 | 0.5 | 0 | 390 | 5 |
| 4. Bal. | 8 | 1 | 14 | 5.5 | 0.5 | 0 | 400 | 8 |
| 5. Bal. | 8 | 1 | 12 | 7 | 1.0 | 0 | 405 | 18 |
| 6. Bal. | 8 | 1 | 14 | 5 | 1.0 | 0 | 387 | 21 |
| 7. Bal. | 8 | 1 | 12 | 6 | 2.0 | 0 | 388 | 26 |
| 8. Bal. | 8 | 1 | 14 | 4 | 2.0 | 0 | 443 | 10 |
| 9. Bal. | 8 | 1 | 12 | 4 | 4.0 | 0 | 386 | 25 |
| 10. Bal. | 8 | 1 | 14 | 2 | 4.0 | 0 | 442 | 0 |
| 11. Bal. | 8 | 1 | 12 | 8 | 0 | 0 | 370 | 7 |
| 12. Bal. | 8 | 1 | 14 | 6 | 0 | 0 | 365 | 8 |
| 13. Bal. | 8 | 1 | 12 | 7.7 | 0 | 0.3 | 390 | 6 |
| 14. Bal. | 8 | 1 | 14 | 5.7 | 0 | 0.3 | 400 | 7 |
| 15. Bal. | 8 | 1 | 12 | 7 | 0 | 1.0 | 427 | 33 |
| 16. Bal. | 8 | 1 | 14 | 5 | 0 | 1.0 | 413 | 35 |
| 17. Bal. | 8 | 1 | 12 | 6 | 0 | 2.0 | 422 | 33 |
| 18. Bal. | 8 | 1 | 14 | 4 | 0 | 2.0 | 433 | 21 |
| 19. Bal. | 8 | 1 | 12 | 4 | 0 | 4.0 | 224 | 58 |
| 20. Bal. | 8 | 1 | 14 | 2 | 0 | 4.0 | 181 | 63 |

Resistance to thermal embrittlement is measured under conditions which simulate the environment that the alloys are likely to encounter in service. To be considered acceptable for tire cord use, the alloys must resist embrittlement during the tire curing operation at about 160° C.–170° C. for one hr. For the sake of safety, the alloys of the present invention were tested by subjecting them to a temperature of 200° C. for one hr. Bend ductility was remeasured after oven-aging.

Tensile strengths were measured on an Instron machine on the as-cast samples. The tensile strengths reported are based on the average cross-sectional area of the ribbons determined from their weight per unit length.

In order to determine the relationships of tensile strength and over-aged bend diameter to alloy composition, the data of Tables V-X were subjected to statistical analysis by multiple regression analysis. The regression equations obtained are presented in Table XI.

TABLE XI

REGRESSION EQUATIONS FOR TENSILE STRENGTH AND OVEN-AGED BEND DIAMETER

Fe—Cr—(Mo,W)—C—P—(B,Si) Alloys

UTS = $424 + 4.58\,Cr' + 5.50\,Mo' + 5.61\,W' - 6.41\,CPBSi' - 0.84\,Cr'.C' - 2.39\,(Cr')^2 - 8.06\,(C')^2 - 16.6\,(CPBSi')^2 - 0.79\,(C')^3$ kpsi F Ratio (9,146) = 22.7

Significance Level = 99.9 + %

Standard Error of Estimate = 33 kpsi

Bend Diam = $16 - 3.5\,Cr' - 6.8\,C' + 9.6\,W' + 9.6\,(CPBSi') - 0.21\,Cr'.C' - 1.9\,C'.W' + 0.18\,(Cr')^2 + 2.1\,(C')^2 - 0.18\,(CPBSi')^2 + 1.3\,(C')^3$ mils F Ratio (9,146) = 17.6

Significance Level = 99.9 + %

TABLE XI-continued

| REGRESSION EQUATIONS FOR TENSILE STRENGTH AND OVEN-AGED BEND DIAMETER | |
|---|---|
| Fe—Cr—(Mo,W)—C—P—(B,Si) Alloys | |
| | Standard Error of Estimate = 10 mils |
| where: | Cr' = (Cr, at % − 7) |
| | C' = (C, at % − 14) |
| | Mo' = 2 . )Mo, at % − 0.5) |
| | W' = 2 . (W, at % − 0.5) |
| | CPBSi' = at % (C + P + B + Si) − 21.5 |

FIGS. 1–6 present response surface contours calculated from the regression equations on several important composition planes.

The composition ranges which yield preferred properties have been shaded on FIGS. 1–6. Such preferred properties include:

400+ kpsi tensile strength;

oven-aged bend diameter less than 15 mils;

30+ days stress corrosion resistance;

(92% R.H., 23° C.).

Figure 2:
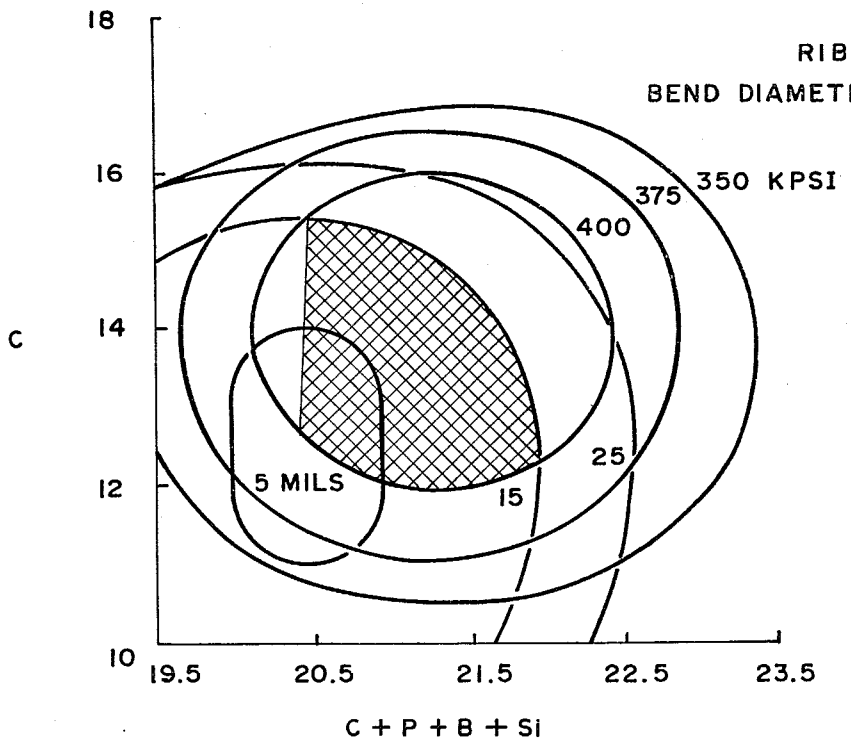

Examination of the response surfaces of FIGS. 1 and 2 shows the critical importance of the carbon and metalloid concentration of the alloys.

From FIG. 1 it is seen that varying the carbon content with total metalloid content and chromium content held constant at 21.5 atom percent and 8 atom percent, respectively, effects tensile strength and oven-aged bend diameter as follows:

| Alloy Composition | | | | | UTS, Ultimate Tensile Strength | Oven-Aged Bend Diameter |
|---|---|---|---|---|---|---|
| Fe | Cr | B | C | P | (kpsi) | Mils |
| Bal. | 8 | 0.5 | 10 | 11 | 333 | 13 |
| | | | 11 | 10 | 361 | 10 |
| | | | 12 | 9 | 387 | 8 |
| | | | 13 | 8 | 407 | 8 |
| | | | 14 | 7 | 415 | 10 |
| | | | 15 | 6 | 407 | 17 |
| | | | 16 | 5 | 378 | 27 |

Tensile strength is seen to pass through a maximum of about 415 kpsi at 14 atom percent carbon. Oven-aged bend diameter passes through a minimum of about 8 mils at 12–13 atoms percent carbon. The preferred properties of the invention are achieved by compositions containing about 13 to 15 atom percent carbon.

Similarly, varying the metalloid content with carbon and chromium content held constant at 14 atom percent and 8 atom percent, respectively, is seen from FIG. 1 to have the following effects:

| Alloy Composition | | | | | UTS | Oven-Aged Bend Diameter |
|---|---|---|---|---|---|---|
| Fe | Cr | B | C | P | (kpsi) | Mils |
| Bal. | 8 | 0.5 | 14 | 5 | 361 | 10 |
| | | | | 6 | 405 | 5 |
| | | | | 7 | 415 | 10 |
| | | | | 8 | 392 | 25 |
| | | | | 9 | 336 | 48 |

Tensile strength passes through a maximum of about 415 kpsi at 21.5 atom percent metalloid. Oven-aged bend diameter passes through a minimum of about 5 mils at 20.5 atom percent metalloid. The preferred properties of the invention are achieved only with about 20.5 to 21.5 atom percent metalloid (an exceedingly narrow range).

The optimal ranges set forth above are broadened somewhat by the addition of molybdenum to the alloy. Comparing FIG. 1 and FIG. 2, it is seen that the preferred properties of the invention are achieved within the following ranges:

| | Range For Preferred Properties | |
|---|---|---|
| Alloy | At % Carbon | At % Metalloid (C + P + B + Si) |
| $Fe_{bal.}Cr_8C_xP_yB_{0.5}$ | 13–15 | 20.5–21.5 |
| $Fe_{bal.}Cr_8Mo_1C_xP_yB_{0.5}$ | 12–15 | 20–22 |

The carbon and metalloid composition ranges for achievement of the preferred properties are broadened somewhat by the addition of molybdenum up to about 4 atom percent.

Figure 3:
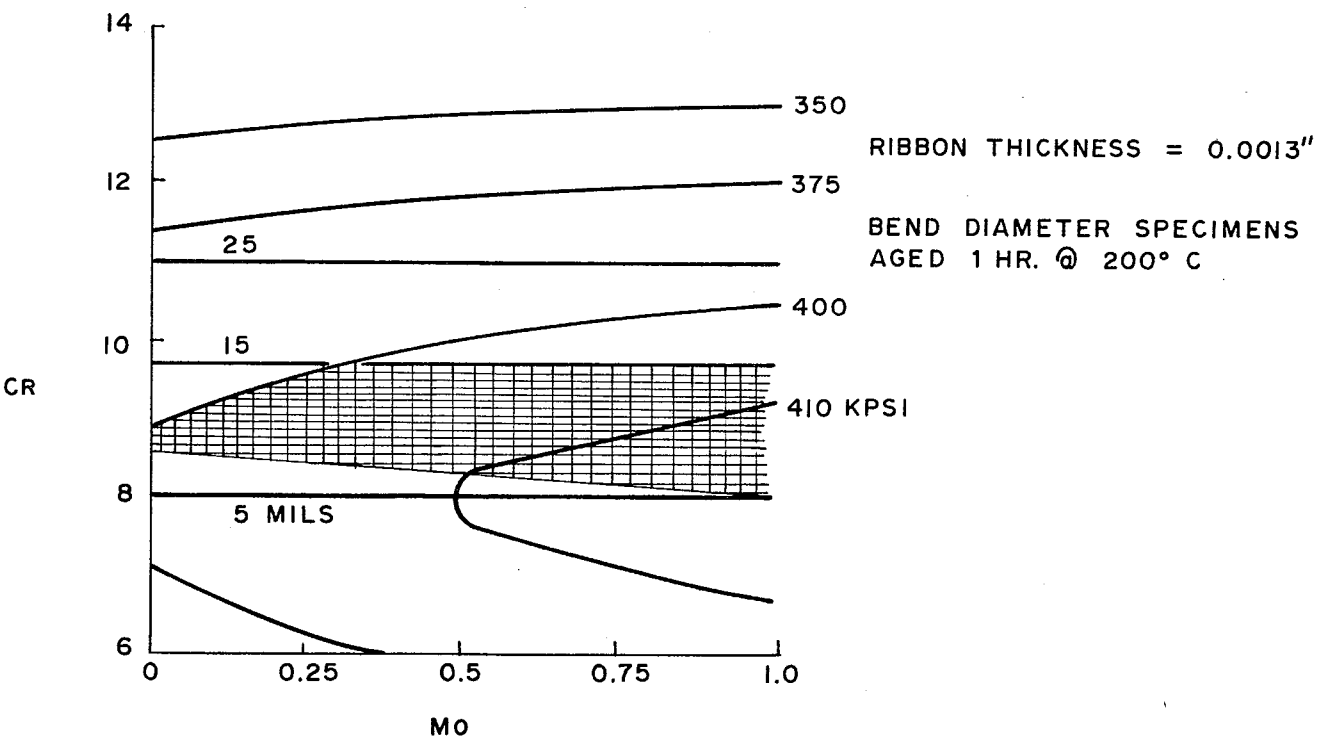
Figure 4:
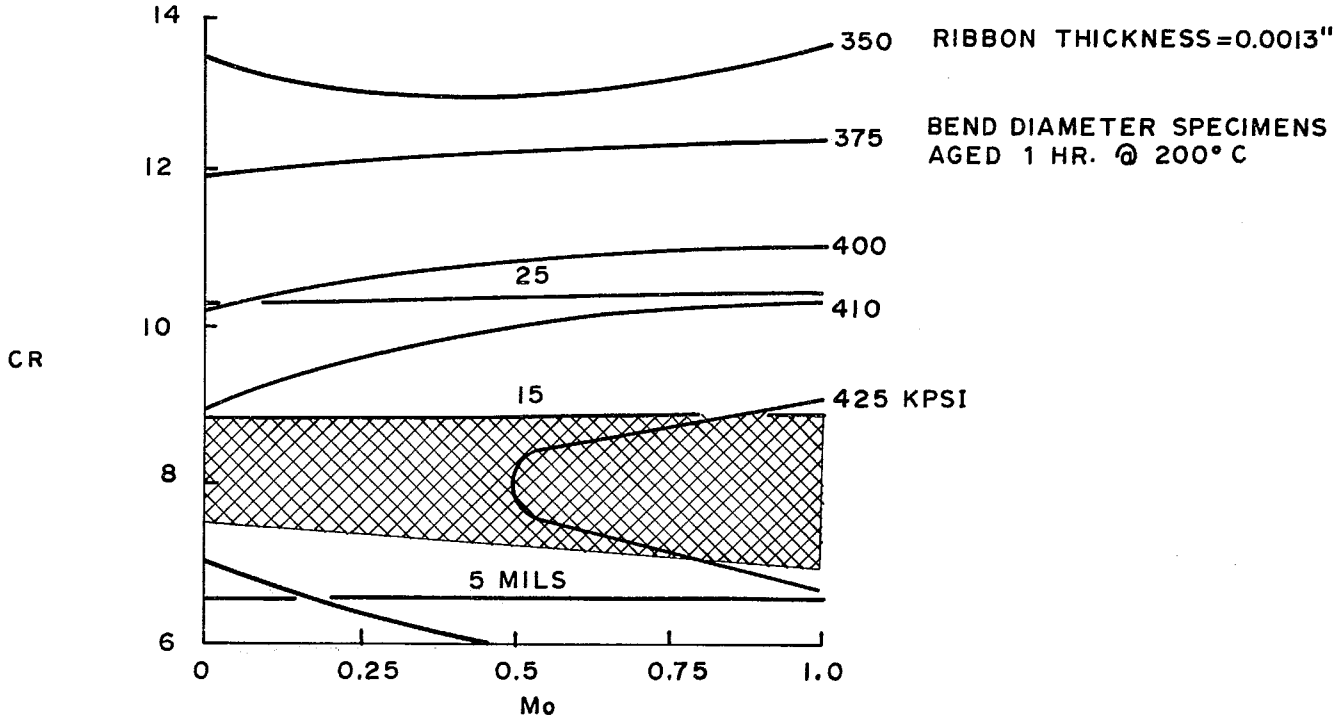
Figure 5:
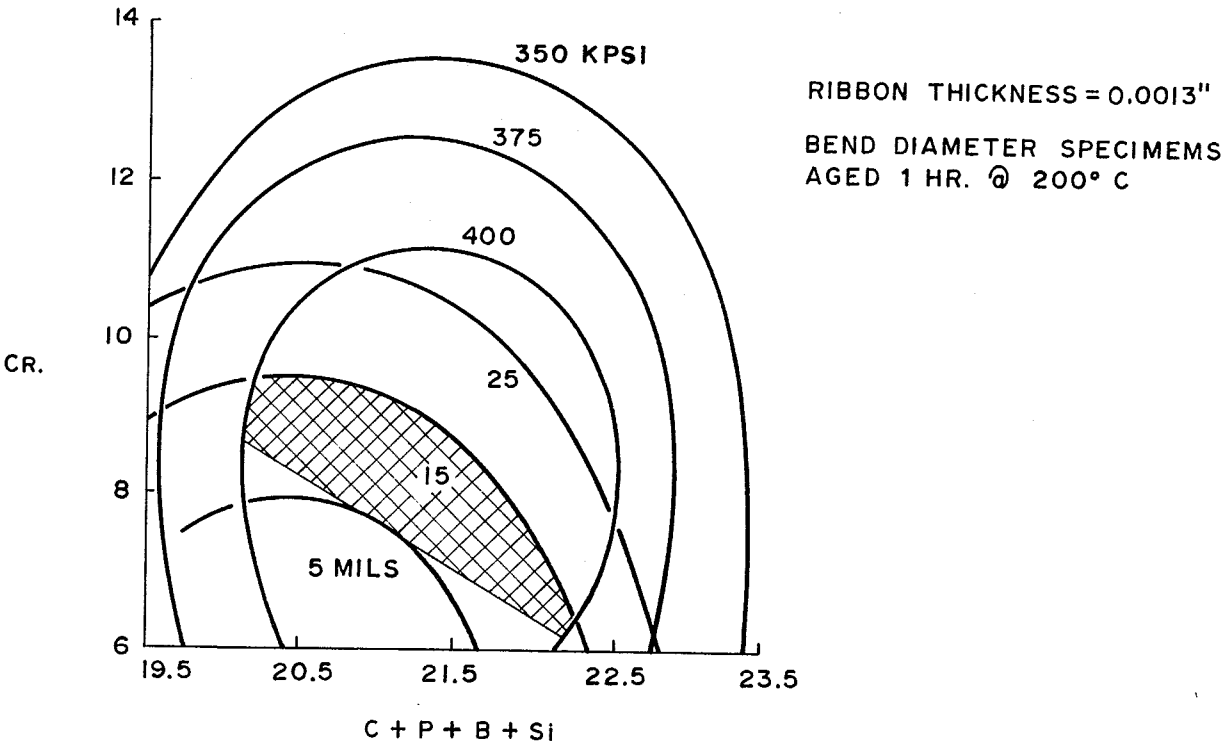

The effects of chromium may be seen from FIGS. 3, 4 and 5. Optimal chromium content is 6–10 atom percent. Higher (or lower) chromium content diminishes tensile strength. Resistance to thermal embrittlement is lessened as chromium is increased but resistance to stress corrosion requires a minimum chromium level given by Eq. 2.

Figure 6:
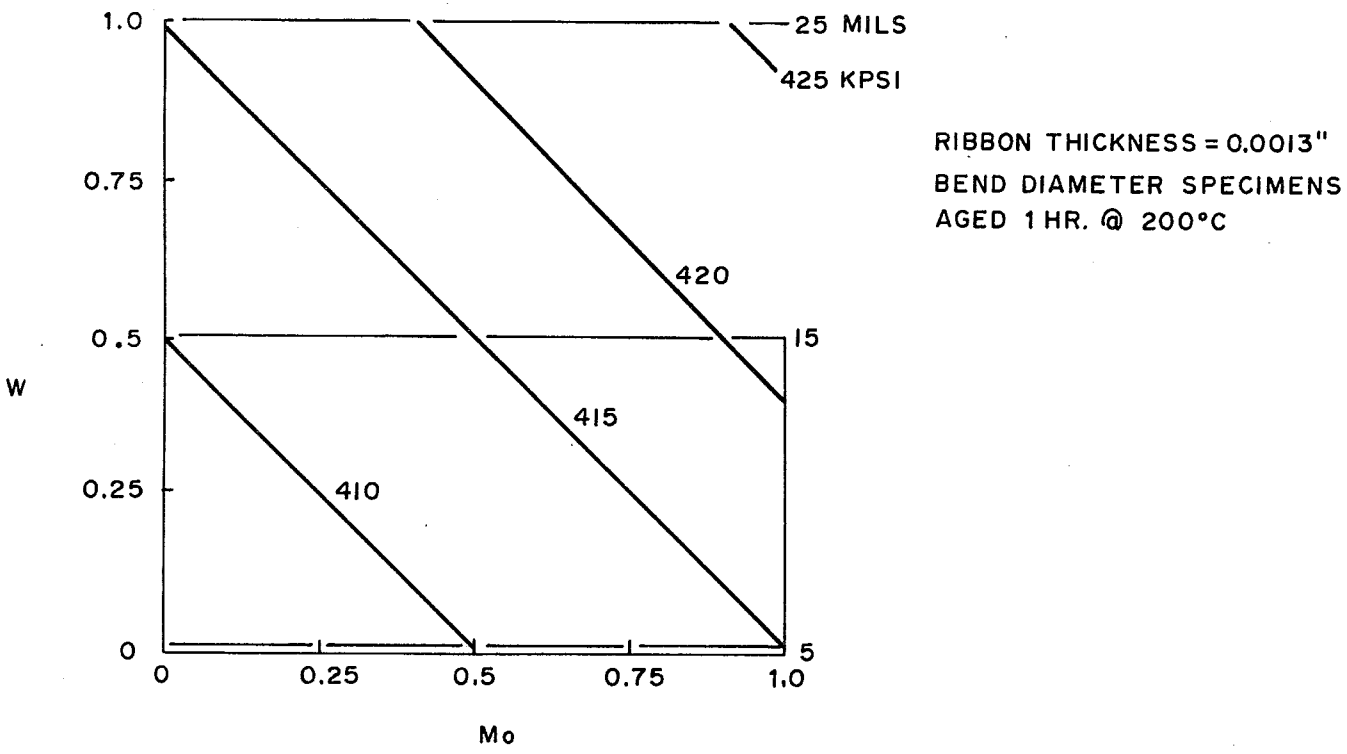

The effects of molybdenum and tungsten upon tensile strength are virtually the same. Tensile strength increases approximately 11 kpsi/at.% for each element over the range 0–1 atom percent (FIG. 6). However, molybdenum in this concentration range has essentially no effect upon theremal embrittlement whereas tungsten worsens thermal embrittlement.

Small concentrations of approximately 0.5 to 1.0 atom percent of silicon and/or boron have essentially parallel effects. Alloys containing 0.5 to 1.0 atom percent combined boron plus silicon show higher tensile strength compared to alloys free of boron and/or silicon.

Figure 7:
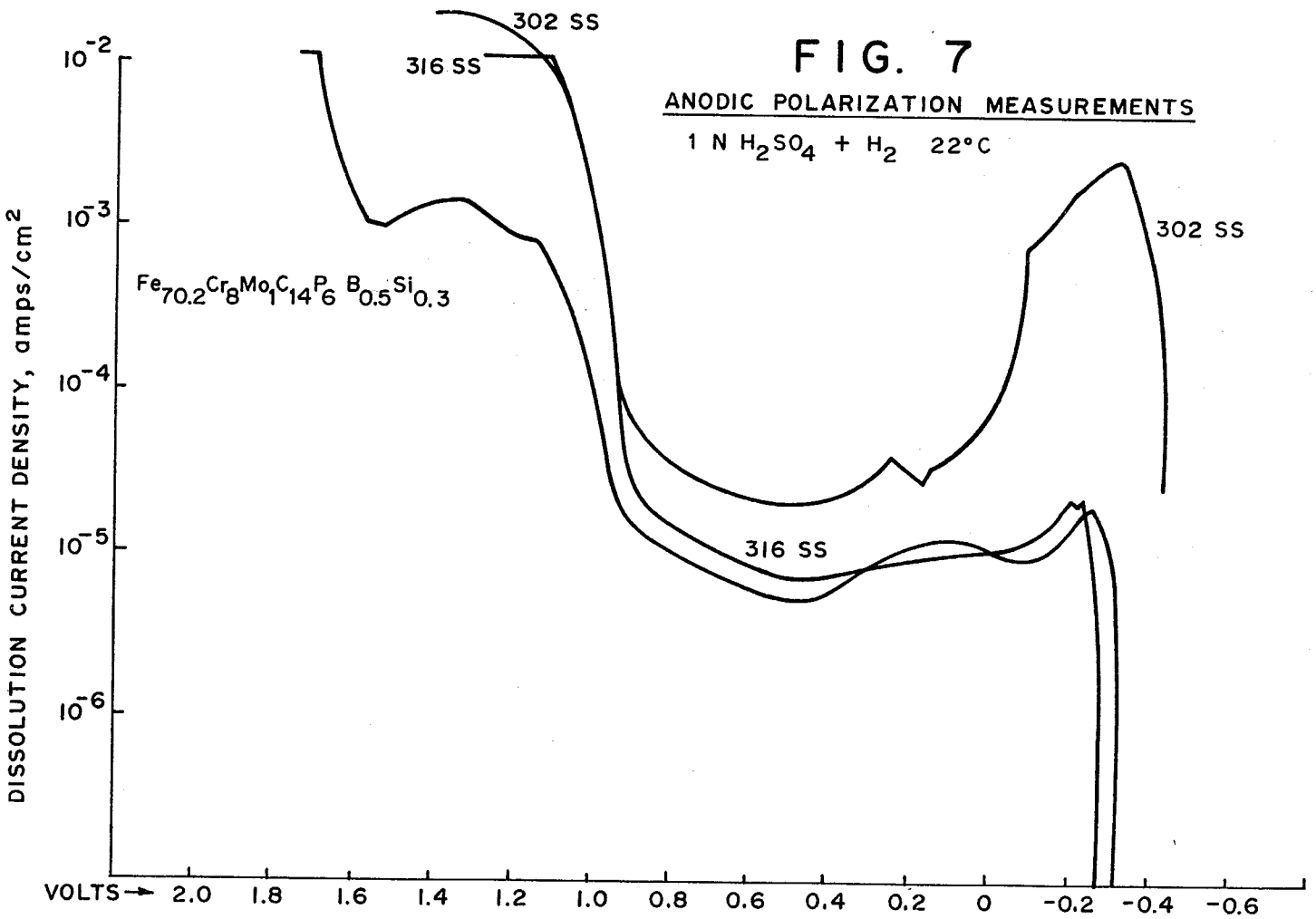
FIGS. 7 and 8 are graphs showing anodic polarization measurements of a preferred alloy of the invention.
Figure 8:
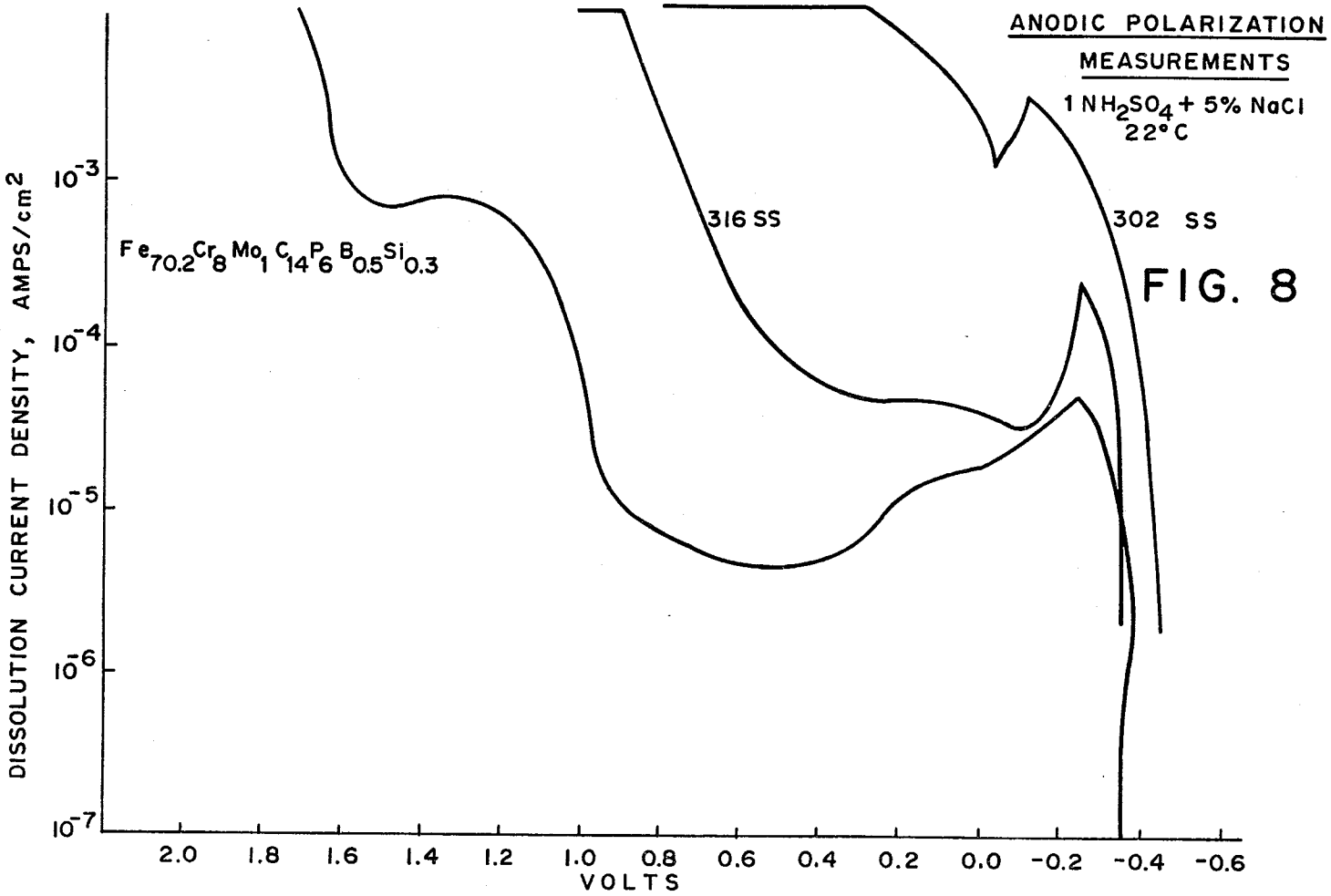

FIGS. 7 and 8 show anodic polarization measurements for one particular alloy of the invention. The resistance of the alloy $Fe_{70.2}Cr_8Mo_1C_{14}P_6B_{0.5}Si_{0.3}$ to corrosion in $H_2SO_4$ is comparable to 316 stainless steel and superior to type 302 stainless steel. In $H_2SO_4$+5% NaCl, the corrosion resistance of the alloy of the invention is superior to both stainless alloys. Moreover, the concentration of scarce, costly and strategic elements such as chromium and molybdenum is much lower in the alloys of the invention than in the stainless steels.

In summary, one group of alloys of the present invention consists essentially of the elements iron, chromium, carbon, and phosphorus combined with minor amounts of molybdenum, tungsten, boron and silicon. The preferred objectives of the invention are achieved with the following composition bounds:

| | |
|---|---|
| Cr | 6–10 at. % |
| C | 12–15 at. % |
| P | 5–10 at. % |
| C + P + B + Si | 20–22 at. % |
| Mo | 0–4 at. % |
| W | 0–0.5 at. % |
| B | 0–4 at. % |
| Si | 0–2 at. % |
| Fe and incidental impurities - balance | |

Further, it has been discovered that the addition of 0.1 to 1 atomic percent copper to base alloys of the invention (1) increases tensile strength at constant thickness (approximately 25 kpsi at 1.0 to 1.7 mil thickness), (2) decreases oven-aged bend diameter approximately 10 mils, and (3) increases the as-cast bend ductility for thicker ribbon.

Figure 9:
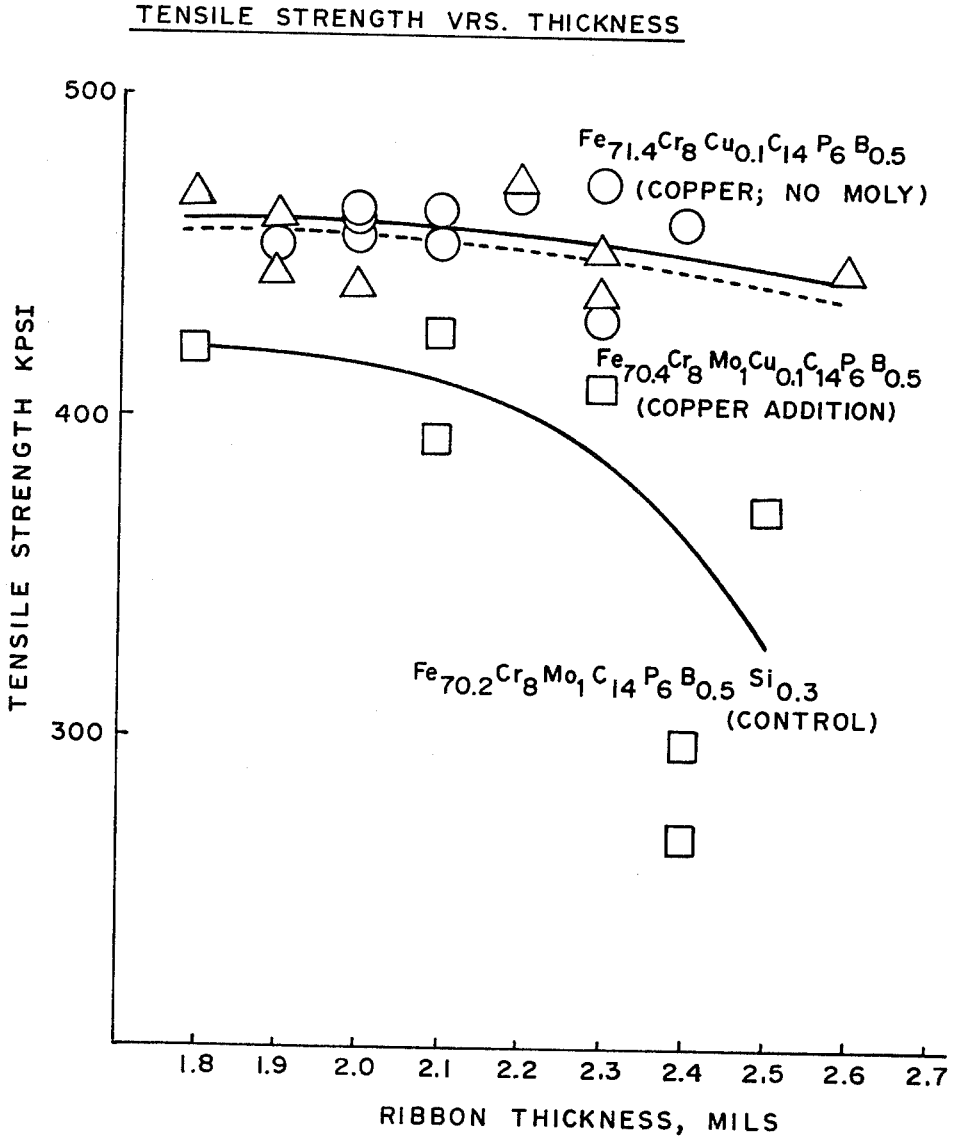
FIG. 9 is a graph showing the change in tensile strength as a function of ribbon thickness for preferred alloys of the invention.

Data illustrating the increased tensile strength and ductility and decreased oven-aged bend diameter are given in Tables XII and XIII and FIG. 9.

TABLE XII

EFFECT OF COPPER ADDITION

| Alloy Composition | Ribbon Dimensions, Mils t | Ribbon Dimensions, Mils w | Tensile Strength kpsi | As-Cast Bend Diam., Mils | SCC, Days |
|---|---|---|---|---|---|
| "Standard" | | | | | |
| $Fe_{70.2}Cr_8Mo_1C_{14}P_6B_{0.5}Si_{0.3}$ | 2.1 | 30 | 392 | 0 | 30+ |
| | 2.1 | 27 | 425 | 0 | |
| | 2.3 | 33 | 409 | 0 | |
| | 2.4 | 29 | 298 | 8 | |
| | 2.5 | 31 | 370 | 8 | 30+ |
| "Standard" + Copper | | | | | |
| $Fe_{70.4}Cr_8Mo_1Cu_{0.1}C_{14}P_6B_{0.5}$ | 1.8 | 21 | 467 | | 30+, 30+ |
| | 1.9 | 22 | 460 | | 30+, 30+ |
| | 1.9 | 26 | 443 | | |
| | 2.0 | 23 | 439 | 0 | |
| | 2.2 | 20 | 473 | | 30+, 30+ |
| | 2.3 | 21 | 450 | | 30+, 30+ |
| | 2.3 | 27 | 436 | | |
| | 2.6 | 22 | 445 | | 30+ |
| No Moly; with Copper | | | | | |
| $Fe_{71.4}Cr_8Cu_{0.1}C_{14}P_6B_{0.5}$ | 1.9 | 26 | 452 | | |
| | 2.0 | 22 | 455 | | |
| | 2.0 | 26 | 464 | | |
| | 2.0 | 28 | 459 | | 7,30+, 30+ |
| | 2.1 | 22 | 463 | | |
| | 2.1 | 26 | 452 | | |
| | 2.2 | 22 | 468 | 0 | 18,25, 30+ |
| | 2.3 | 21 | 471 | | |
| | 2.3 | 23 | 428 | | |
| | 2.4 | 23 | 460 | | |
| | 2.6 | 23 | 459 | | |
| | 1.9 | 19 | 440 | | 12,30+ |
| | 2.1 | 19 | 429 | | 5,30+ |
| | 2.4 | 20 | 411 | | 1,19 |
| | 2.5 | 20 | 439 | | 1,8 |
| | 2.9 | 21 | 414 | | 1,5 |
| Low Moly; with Copper | | | | | |
| $Fe_{70.85}Cr_8Mo_{.25}Cu_{.1}C_{14}P_6B_{.5}Si_{.3}$ | 2.2 | 22 | 440 | 0 | 30+ |

TABLE XIII

EFFECT OF COPPER ADDITION

| Alloy Composition | T, °C. | Aging Time, Hrs. | Bend, Diam., Mils |
|---|---|---|---|
| "Standard" | | | |
| $Fe_{70.2}Cr_8Mo_1C_{14}P_6B_{0.5}Si_{0.3}$ | 200 | 1 | 0 |
| | | 2 | 0 |
| | | 4 | 0 |
| 2.1 × 27 mils | 250 | ½ | 18 |
| | | 2 | 34 |
| | | 4 | 43 |
| "Standard" + Copper | | | |
| $Fe_{70-1}Cr_8Mo_1Cu_{0.1}C_{14}P_6B_{0.5}Si_{0.3}$ | 200 | 1 | 0 |
| | | 2 | 0 |
| | | 4 | 0 |
| 2.0 × 23 mils | 250 | ½ | 7 |
| | | 1 | 13 |
| | | 2 | 37 |

TABLE XIII-continued

EFFECT OF COPPER ADDITION

| Alloy Composition | T, °C. | Aging Time, Hrs. | Bend, Diam., Mils |
|---|---|---|---|
| | | 4 | 39 |
| Mo Moly; with Copper | | | |
| $Fe_{71.4}Cr_8Cu_{0.1}C_{14}P_6B_{0.5}$ | 200 | 1 | 0 |
| | | 2 | 0 |
| | | 4 | 0 |
| 2.0 × 28 mils | 250 | ½ | 14 |
| | | 1 | 16 |
| | | 1 | 16 |
| | | 2 | 32 |
| | | 4 | 34 |
| Low Moly; with Copper | | | |
| $Fe_{70.85}Cr_8Mo_{.25}Cu_{.1}C_{14}P_6B_{.5}Si_{.3}$ 2.2 × 20 mils | 200 | 1 | 0 |

The presence of 0.1 to 1 atomic percent copper in Fe—Cr—(Cu,Mo,W)—P—C—(B,Si) alloys shifts the regression equations for tensile strength and bend diameter in the manner shown in Table XIV.

TABLE XIV

EQUATIONS FOR TENSILE STRENGTH AND OVEN-AGED BEND DIAMETER

Fe—Cr—Cu—(Mo,W)—C—P—(B,Si) Alloys
0.1 to 1.0 At. % Copper

UTS = $449 + 4.58\,Cr' + 5.50\,Mo' + 5.61\,W' - 6.41\,CPBSi' - 84\,Cr'.C' - 2.39\,(Cr')^2 - 8.06\,(C')^2 - 16.6\,(CPBSi')^2 - 0.79\,(C')^3$ kpsi Bend Diam = $6 - 3.5\,Cr' - 6.8\,C' + 9.6\,W' + 9.6\,(CPBSi') - 0.21\,Cr'.C' - 1.9\,C'.W' + 0.18\,(Cr')^2 + 2.1\,(C')^2 - 0.18\,(CPBSi')^2 + 1.3\,(C')^3$ mils Where:
$Cr' = (Cr, \text{at } \% - 7)$
$C' = (C, \text{at } \% - 14)$
$Mo' = 2 \cdot (Mo, \text{at } \% - 0.5)$
$W' = 2 \cdot (W, \text{at } \% - 0.5)$
$CPBSi' = \text{at } \% (C + P + B + Si) - 21.5$ Referring again to FIGS. 1–6, the addition of copper expands somewhat the domain of the essential elements in which the preferred objectives may be achieved. Thus, in FIGS. 1–6, the contour lines for 375 kpsi become the contour lines for 400 kpsi when 0.1 to 1 atomic percent copper is incorporated in the alloy.

Similarly, the contour lines for 25 mil oven-aged bend diameter become the contour lines for 15 mil oven-aged bend diameter when 0.1 to 1 atomic percent copper is incorporated in the alloy.

Accordingly, a second group of alloys of the present invention consist essentially of the elements iron, chromium, carbon and phosphorus combined with minor amounts of molybdenum, tungsten, boron, silicon and copper. The preferred objectives of the invention are achieved within the following composition ranges:

| | |
|---|---|
| Cr | 4–11 at. % |
| C | 11–16 at. % |
| P | 4–10 at. % |
| C + P + B + Si | 19–24 at. % |
| Mo | 0–4 at. % |
| W | 0–0.5 at. % |
| B | 0–4 at. % |
| Si | 0–2 at. % |
| Cu | 0.1–1 at. % |
| Fe and incidental impurities-balance | |

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. Metal alloy that is primarily glassy, has improved ultimate tensile strength, bend ductility, resistance to thermal embrittlement and resistance to corrosion and stress corrosion, said alloy having a composition defined by the formula $Fe_aCr_bC_cP_dMo_eW_fCu_gB_hSi_i$ where "a" ranges from about 61 to 75 atom percent,
"b" ranges from about 6 to 10 atom percent,
"c" ranges from about 11 to 16 atom percent,
"d" ranges from about 4 to 10 atom percent,
"e" ranges from about 0 to 4 atom percent,
"f" ranges from about 0 to 0.5 atom percent,
"g" ranges from about 0 to 1 atom percent,
"h" ranges from about 0 to 4 atom percent, and
"i" ranges from about 0–2 atom percent, with the proviso that the sum [c+d+h+i] ranges from 19 to 24 atom percent and the fraction [c/(c+d+h+i)] is less than about 0.84.

2. A metal alloy as recited in claim 1, wherein "g" is 0, "c" ranges from about 12 to 15 atom percent, "d" ranges from about 5 to 10 atom percent, and the sum [c+d+h+i] ranges from 20 to 22 atom percent.

3. A metal alloy as recited in claim 1, having a composition consisting essentially of $Fe_{70.4}Cr_8Mo_1Cu_{0.1}Co_{14}P_6B_{0.5}$.

4. A metal alloy as recited in claim 1, having a composition consisting essentially of $Fe_{71.4}Cr_8Cu_{0.1}C_{14}P_6B_{0.5}$.

5. A metal alloy as recited in claim 1, having a composition consisting essentially of $Fe_{71}Cr_8Mo_1C_{14}P_{5.7}Si_{0.3}$.

6. A metal alloy as recited in claim 1, having a composition consisting essentially of $Fe_{70.2}Cr_9Mo_1C_{15}P_4B_{0.8}$.

7. A metal alloy as recited in claim 1, having a composition consisting essentially of $Fe_{70.85}Cr_8Mo_{0.25}Cu_{0.1}C_{14}P_6B_{0.5}Si_{0.3}$.

8. A metal alloy as recited in claim 2, wherein "e" and "f" are 0, "c" ranges from about 13 to 15 and the sum [c+d+h+i] ranges from 20.5 to 21.5.

* * * * *